US005902199A

United States Patent [19]

Adams, Jr.

[11] Patent Number: 5,902,199

[45] Date of Patent: May 11, 1999

[54] ARCHERY ARROW TUNING METHOD AND APPARATUS

[76] Inventor: Charles C. Adams, Jr., Jackson, Wyo.

[21] Appl. No.: 09/006,590

[22] Filed: Jan. 13, 1998

[51] Int. Cl.[6] ..... F42B 6/04

[52] U.S. Cl. ..... 473/578

[58] Field of Search ..... 124/23.1; 473/578, 473/582, 583, 585, FOR 216, FOR 219, FOR 220, FOR 221

[56] References Cited

U.S. PATENT DOCUMENTS

| | | | |
|---|---|---|---|
| 3,815,916 | 6/1974 | Meszaros | 473/586 |
| 4,874,180 | 10/1989 | Fingerson et al. | 473/578 |
| 4,944,520 | 7/1990 | Fingerson et al. | 473/582 |
| 5,114,156 | 5/1992 | Saunders | 473/582 |
| 5,269,534 | 12/1993 | Saunders et al. | 473/582 |

OTHER PUBLICATIONS

"Convertible Points for Aluminum Arrows", Archery Magazine, Jan. 1969, page 25.

*Primary Examiner*—John A. Ricci

*Attorney, Agent, or Firm*—Mallinckrodt & Mallinckrodt

[57] ABSTRACT

An archery bow is tuned by making a tuning arrow that either has a tuning point rather than a broadhead, wherein the tuning point compensates for the weight and balance of the broadhead, weight at the rearward portion of the arrow instead of fletching and which compensates for the weight and balance of the fletching, or both. This produces a tuning arrow having substantially the same weight and balance point as the arrows to be shot from the bow during normal shooting. The tuning arrow is used to tune the bow and because the weight and balance point are substantially equal to the weight and balance point of the arrows normally shot from the bow, the tune obtained using the tuning arrow is the correct tune for the normal arrows also.

24 Claims, 6 Drawing Sheets

ARCHERY ARROW TUNING METHOD AND APPARATUS

BACKGROUND OF THE INVENTION

1. Field

The invention is in the field of tuning archery bows and archery arrows.

2. State of the Art

For target shooting and hunting, it is important that an archer be able to accurately shoot an arrow from a bow. This means that each time an arrow is aimed and shot from a bow, it should fly similarly to other similar arrows aimed and shot similarly from that bow and hit a target in the same place. In order to accurately shoot an arrow from an archery bow, the bow should be correctly set up and the arrow shaft matched to the bow. The bow set up includes proper adjustment of the tiller of the bow and, for compound bows, timing of the wheels. The bow manufacturer generally provides instructions and information on properly adjusting these characteristics. The arrow rest used should be compatible with either a finger release or a mechanical bowstring release as used by the archer. The arrow shaft should be properly chosen to match the bow's draw length, draw weight, bowstring material, compound wheel type, string release type, and arrowhead weight to be used. Several arrow shaft manufacturers provide selection guides to help the archer select the proper arrow shaft for use in particular circumstances. Further, the fletching, arrowhead, and shaft used have to be matched to provide a correct front of center balance point for the arrow. Generally, the assembled arrow should have a balance point 10% to 15% front of center.

With correct bow set up, arrow shaft selection, and arrow balancing, it is still necessary to properly adjust the positioning of the chosen arrow rest and the nocking point of the arrow on the bowstring in order to achieve repeatable accurate shots from the bow. The nocking point is generally established by a nock locator such as a metal ring or hard or soft yolk on the bowstring. For example, it is common practice to position a metal ring on the bowstring as a positioning guide for the nock of the arrow. The arrow is then always nocked immediately below the ring. These adjustments are generally involved in "tuning the bow". An arrow shot from a bow properly tuned for that arrow will travel accurately as aimed in a substantially straight line with minimal wobbling or porpoising. However, arrows of different weight and/or balance point may not fly accurately as aimed.

There are several methods commonly used in tuning a bow. One is to shoot several similar arrows at a target and make adjustments to the arrow rest and nocking point indicator until the several arrows when similarly aimed and shot by the archer all hit the target relatively close to one another and relatively close to where aimed. Broadheads are not generally used for target shooting and the arrows used here will generally have a field point. Another is to shoot an arrow through a piece of paper and observe the hole made by the arrow as it passes through the paper. Ideally, the hole should be no bigger than the arrow fletching indicating that the arrow passed straight through the paper. An elongate hole indicates the arrow is not aligned in the direction of flight or excessive wobbling or porpoising of the arrow is taking place. It has been suggested that a bare shaft, i.e., without fletching, be used so that the fletching does not rip a large hole in the paper. In this way, the hole formed more accurately shows movement of the arrow. However, removal of the fletching changes the weight and balance point of the arrow so the bow would not be tuned for a normal arrow if tuned to a bare shaft. Arrows used for paper tuning also generally have a field point rather than a broadhead hunting point. A broadhead would make a larger hole in the paper so it would be very difficult to determine the arrow flight characteristics. Tuning by any method using an ordinary field point does not produce a proper tune for an arrow with a broadhead. The balance of the arrow is different in each case. Even if the point is of the same weight as a broadhead to be used, the broadhead changes the balance point of the arrow.

Various devices have been developed to help tune a bow by locating a nocking point on the bowstring, see, for example, U.S. Pat. Nos. 5,175,937 and 4,596,229, and various stands or shooting machines have been developed for drawing and releasing a bow in a set repeatable manner so adjustments can be made to obtain repeatable arrow performance under the same shooting parameters, see, for example, U.S. Pat. Nos. 5,628,300, 5,121,736, and 4,993,397. However, while these devices may provide a rough tune and starting point for a fine tune, they cannot finely tune the bow to the archer's particular shooting style.

The problem of the change of balance of the arrow when changing from a field or target point to a broadhead has been recognized by U.S. Pat. No. 5,496,043 which describes a special broadhead which fits over the outside of the forward portion of the arrow shaft so that the overall length of the arrow remains substantially the same with a field point or with the special broadhead. However, the method disclosed in the U.S. Pat. No. 5,496,043 limits an archer to use of the special broadhead disclosed and does not work for the many varying broadheads currently on the market or currently owned by various archers. Most archers will probably have a number of their preferred broadheads and not want to switch to another broadhead.

SUMMARY OF THE INVENTION

According to the invention, an archery bow is tuned by using a weight compensated tuning arrow wherein one or more items extending from the arrow shaft of the arrow normally shot from the bow and for which arrow it is desired to tune the bow is removed from the arrow and weight is added to the arrow to compensate for the removed item so that the overall weight of the tuning arrow and the balance point of the tuning arrow are substantially the same as the arrow for which the bow is to be tuned. The items removed will be either a broadhead, the arrow fletching, or both the broadhead and the arrow fletching. Where a bow is to be tuned for an arrow with a broadhead, a special arrow tuning point constructed and configured to be equal in weight to a selected broadhead and to have a similar balance point location forwardly of its rearward end as the selected broadhead, is used on the arrow for tuning purposes rather than the broadhead or rather than a field point normally used in place of a broadhead when tuning a bow. The special tuning point may also be used for target shooting and non-big game hunting where the usual field point would normally be used. Because the weight and balance point location of the tuning point is substantially the same as a desired broadhead, the balance point and flight characteristics of the arrow remain the same when the desired broadhead is used rather than the tuning point. In addition, for fine tuning, the arrow fletching normally used by the archer is removed and replaced with weight substantially equal to the weight of the fletching removed and similarly positioned so tuning takes place without the stabilizing effects of the fletching but with the same weight and balance point of the arrow maintained so the tune is correct for an arrow with the desired fletching.

Where the bow is to be fine tuned for use with an arrow having a field point or a target point, rather than an arrow using a broadhead, the field point or target point as normally used by the archer will be used on the tuning arrow, but the fletching will be removed and replaced with weight substantially equal to the weight of the fletching removed and similarly positioned to again eliminate the stabilizing effect of the fletching but maintain the same arrow weight and balance point for the tuning arrow as if the fletching was present.

In a preferred form of the invention, the fletching is removed from the arrow shaft, the weight of the fletching determined, either from tables or from weighing the removed fletching, and a weight strip of weight equal to the removed fletching is attached, such as by adhesive, to the arrow shaft along the rearward portion of the arrow shaft where the fletching was removed. Rather than using a single weight strip, multiple weight strips positioned where fletching was removed or would normally be positioned can be used, or, in some cases a weight tape may be wrapped around the arrow shaft in the area where the fletching was removed. Various tapes may be used as the weight tape such as electrical or duct tape.

When tuning for an arrow with a broadhead, the broadhead should not be used on the tuning arrow. Most broadheads available today weigh within the range of about 75 grains to about 140 grains. The length of the broadheads vary from about 2 inches to about 3 inches depending upon weight, the longer length broadheads being the heavier broadheads. Each broadhead has its own balancing point or center of gravity along its length at a distance forwardly of its rearward end. While there are a wide variety of broadheads currently commercially available to archers, it has been found that most broadheads of a given weight have very similar balance point locations. These locations are generally within about one-quarter inch of one another and usually within about one-eighth inch of one another. Because of this, it has been found that by configuring a tuning point so that its balance point location forwardly of its rearward end is substantially the same as the location of the balance point forwardly of the rearward end of a similar weight broadhead, a single tuning point of given weight can be used to tune for any broadhead of substantially the same weight. An archery bow can be tuned for a desired broadhead by using a similar weight tuning point of the invention on the forward end of the tuning arrow. To make a tuning arrow, the archer determines the weight of the broadhead that he intends to shoot. This weight can be determined from markings on the broadhead or its packaging, or, since it has been found that some broadheads can vary from the marked weight, the desired broadhead can be weighed by the archer. The archer then selects a tuning point which is preferably within about 2.5 grains of the weight of the broadhead. This tuning point is secured to the forward end of the arrow shaft to form the tuning arrow. This arrow may then be used to tune the bow using conventional bow tuning techniques. While a reasonable tune can be obtained by merely using the tuning point of the invention, for a fine tune of the bow, the fletching should also be removed and compensated for as explained above.

The tuning point of the invention may be made a length approximately equal to the length of a similar weight broadhead, but can be of other lengths, such as shorter, as long as the location of the balance point of the tuning point is substantially the same as the balance point of a similar weight broadhead. Such tuning point, however, will be longer than the usual field point.

A preferred tuning point of the invention has an elongate body with a threaded rearward end portion which screws into the usual threaded insert at the forward end of the arrow shaft. A slightly larger diameter unthreaded portion also fits into the forward end of the shaft in normal manner and ends in a shoulder which abuts the forward end of the arrow shaft when the tuning point is securely screwed into the shaft. A tip is formed at the forward end of the elongate body. The overall length of the tuning point is approximately equal to the overall length of a similar weight broadhead, although, as mentioned above, it does not have to be. To provide a weight distribution in the point that approximately matches the weight distribution over the length of a similar weight broadhead, it is presently preferred that the body be made of aluminum and have a separate screw-in steel tip. Further, an intermediate portion of the body is configured to receive a steel collar to add weight at that location to the point. With the steel tip insert and the steel collar, the balance point of a similar weight broadhead can be closely approximated.

The tuning points can be made in various weights to match the range of available broadheads, or in ranges targeted to particular broadheads. For example, tuning points weighing 75 grains, 90 grains, 100 grains, 120 grains, and 125 grains can be made available to archers to match specific broadheads of those weights or a range of broadhead weights between those weights, or various other weight tuning points or assortment of tuning points could be provided. In addition, 5 grain auxiliary weight collars may be provided which can be added to a tuning point to increase its weight. Generally one or two such collars, and sometimes three such collars, may be added over the unthreaded portion of the point to be sandwiched between the forward end of arrow shaft and the shoulder of the tuning point to increase the tuning point weight by 5, 10, or 15 grains. Weight collars can also be added to broadheads in order to produce a broadhead weight within 2.5 grains of the tuning point weight.

The tuning point may also be configured to have a variable weight over a range of weights and for that purpose, may have a portion thereof to which weight may be added or subtracted, in addition to the weight collars described above. In a preferred form of this embodiment, the internally threaded bore into which the tip is screwed is made to extend into the body to an extent greater than to merely accept the threaded portion of the tip so that selected weight can be screwed into the bore and positioned therein to maintain a desired balance point of the tuning point. Further, in some cases the tuning point can utilize the body of the desired broadhead with broadhead blades removed and weight added to weight and balance compensate the broadhead for the removed blades. For this purpose a sleeve may be positioned over the broadhead body and broadhead body with sleeve used as the tuning point.

THE DRAWINGS

The best mode presently contemplated for carrying out the invention is illustrated in the accompanying drawings, in which:

FIG. 1 is a side elevation of a typical compound archery bow;

FIG. 2, a side elevation of a typical archery arrow with a typical field point;

FIG. 3, a side elevation of a typical archery arrow similar to that of FIG. 2, but showing a typical broadhead rather than a field point;

FIG. 4, a side elevation of an archery arrow similar to that of FIGS. 2 and 3, but showing the tuning point of the invention rather than the field point or broadhead;

FIG. 5, a vertical section through the tuning point and forward portion of the arrow shaft of FIG. 4, showing most of the tuning point in elevation;

FIG. 6, a vertical section similar to that of FIG. 5, showing additional weight collars added to the tuning point;

FIG. 7, a vertical section through a tuning point of the invention having a central bore to receive weight;

FIG. 8, a vertical section similar to that of FIG. 7 showing selected weight in the central bore;

FIG. 9, a vertical section through an illustrative broadhead;

FIG. 10, a vertical section similar to that of FIG. 9, but showing the broadhead converted to a tuning point of the invention;

FIG. 11, a side elevation of an archery arrow similar to that of FIG. 4 showing the tuning point, but with fletching removed and a weight strip added to compensate for the removed fletching; and FIGS. 12–18, diagrams of various paper tears showing results obtained during paper tuning.

DETAILED DESCRIPTION OF THE ILLUSTRATED EMBODIMENTS

Figure 1:
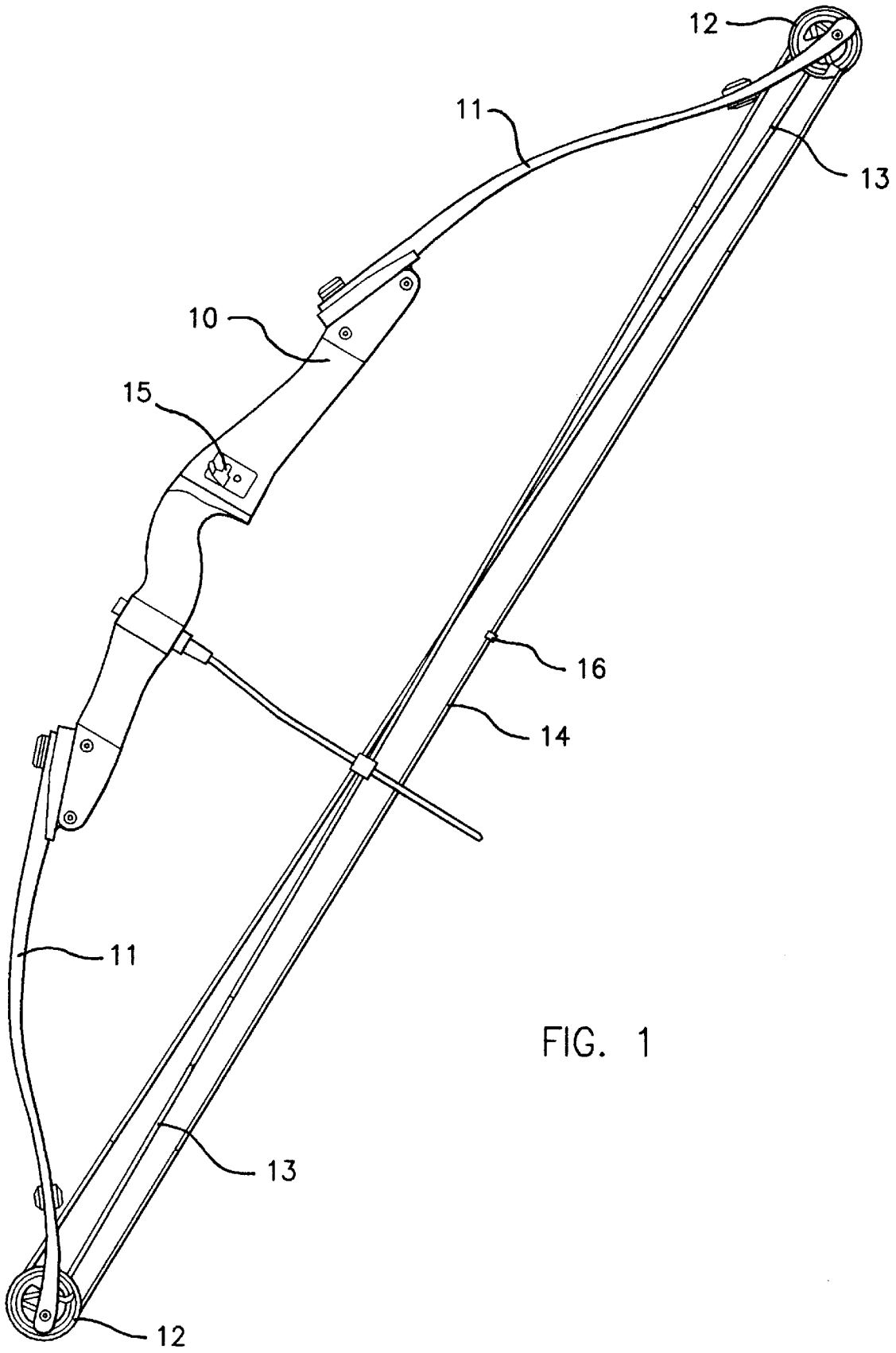

A typical compound archery bow is shown in FIG. 1. The bow includes a handle riser 10 with limbs 11 extending from the ends thereof. Wheels 12 are eccentrically mounted at the outer ends of limbs 11 with cables 13 and bowstring 14 extending between the wheels. An arrow rest 15 is mounted in normal position on handle riser 10 and a nock locator in the form of a clamp-on metal ring 16, is secured to the bowstring 14. The basic arrow rest shown is merely for illustrative purposes as there are numerous types of arrow rests available, many of which have various lateral adjustments that can be made to appropriately position the arrow holding portion of the rest. In use, an arrow is placed on the arrow rest and the arrow is nocked on the bowstring immediately below the nock positioning ring 16. Ring 16 ensures that the arrow is nocked in the same position on the bowstring each time.

In order to accurately shoot an arrow from the bow, the bow must be correctly set up and balanced. Also, the arrow shaft must be properly matched to the bow characteristics and the broadhead and fletching to be used. In addition, the rest, bowstring, and nock locator must be properly positioned and aligned. The bow manufacturer generally provides instruction on properly setting up the bow, and there are various arrow shaft selection guides which can be used to properly select an arrow shaft for use with particular bows and broadheads. The selection of the broadhead and fletching as well as any auxiliary weighting of the broadhead are important to balance the arrow. It is currently recommended that for broadheads the balance point or center of gravity of an arrow, i.e., the point along the arrow shaft with equal weight forwardly and rearwardly of such point so that the arrow will balance at such point, be in the range of about 10% to 15% front of center (F.O.C. %), i.e., be located 10% to 15% of the length of the arrow forwardly of the center or midpoint of the length of the arrow. The length of the arrow for purposes of determining F.O.C. % is measured from the bottom of the nock to the forward end of the arrow shaft. To increase the F.O.C. % for a given arrow shaft, the weight of the arrow point, such as the broadhead, must be increased or the weight of the fletching decreased. To reduce the F.O.C. % for a given arrow shaft, the weight of the arrow point, such as the broadhead, has to be reduced or the weight of the fletching increased.

With proper bow adjustment and proper arrow shaft selection and weighting, it is still necessary to properly align the arrow rest 15 and the nock indicator 16. The present invention is concerned with this alignment. This alignment is initially set by sighting and by instruments such as a bowstring square which is similar to a T-square which aligns the nock locator so that an arrow properly resting on the arrow rest is approximately perpendicular to the bowstring in brace position. However, once this position is established, tuning of the bow, i.e., positioning and aligning of the arrow rest and nock indicator, is generally desirable. This tuning may be done by shooting arrows from the bow and observing the consistency in the flight of such arrows or by other methods such as shooting the arrows through a sheet of paper and observing the hole made by the arrow.

When using an arrow to tune a bow, it is important that the tuning arrow, i.e., the arrow used to tune the bow, be substantially the same as the arrows that the archer will use when actually shooting the bow. This means that the arrow shaft is substantially the same and that the arrow is substantially the same in weight and arrow balance point. For big game hunting, an archer will normally use a broadhead point at the forward end of the arrow shaft. This means, that in tuning the bow for an arrow with a broadhead, the archer should use a tuning arrow having the same characteristics as the arrow with a broadhead attached. However, it is generally not desirable to use an arrow with a broadhead attached as a tuning arrow. This is because the use of the broadhead is more dangerous than use of a field point on the arrow and use of the broadhead during tuning could result in damage to the broadhead, which is generally relatively expensive, and in damage to any target used. Further, the use of a broadhead is inappropriate for some tuning methods, such as a paper tuning method, because the broadhead would make such a large hole in the paper it would be impossible to determine anything about arrow flight from the hole. Therefore, it is usual practice to use a field point on a tuning arrow.

Figures 2, 3, 4, 11:
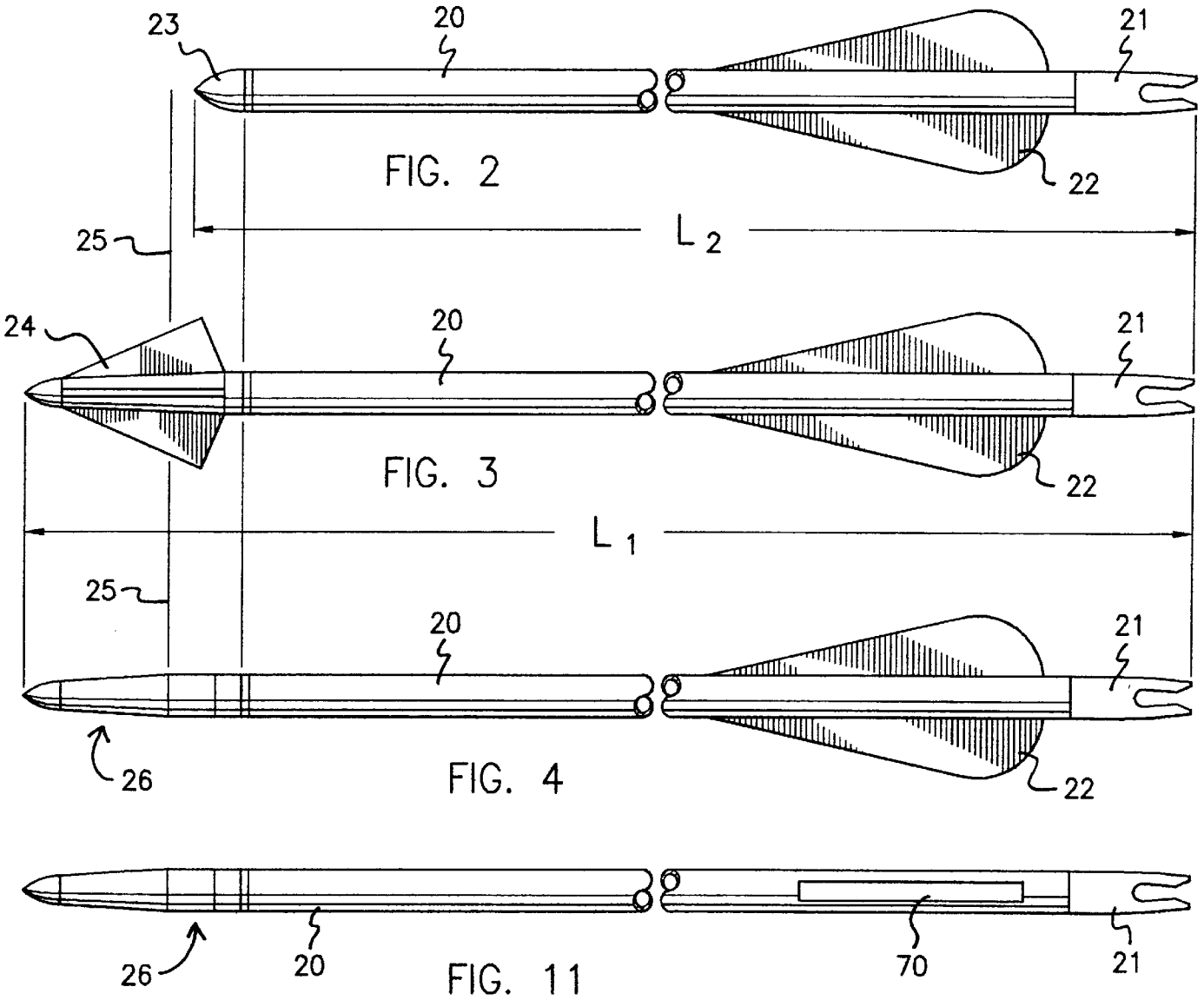

The use of a standard field point on a tuning arrow used to tune a bow for use with a broadhead causes several problems. FIG. 2 shows an arrow with arrow shaft 20, nock 21, fletching 22, and a standard field point 23. FIG. 3 shows an arrow with identical arrow shaft, nock, and fletching, but with a broadhead 24 secured to the front of the arrow shaft 20. Several problems arise when tuning with the field point arrow of FIG. 2 and then shooting the broadhead arrow of FIG. 3. First, if the field point and broadhead are not of the same weight, the weight and balance point of the two arrows are not the same. Thus, tuning for the field point arrow does not tune for the broadhead. Even if the weight of the field point is the same as the weight of the broadhead, the length of the broadhead, as shown, is substantially greater than the length of the field point. The balance point of the broadhead 24, i.e., the center of gravity or point along the length of the broadhead that the broadhead alone will balance, is approximately at 25 which is forward of the front of the normal field point 23. This causes the balance point of the arrow to change so that the tune for the shorter arrow with the field point is not the proper tune for the longer arrow with the broadhead.

FIG. 4 shows the arrow with a tuning point 26 of the invention secured to the forward end of arrow shaft 20. It will be noted that tuning point 26 is substantially longer than normal field point 23. Tuning point 26 is configured to have a weight within about 2.5 grains of the weight of broadhead 24 and a balance point at 25, substantially the same location forwardly of the forward end of the arrow shaft 20 as the balance point of broadhead 24. It has been found that balance points within about one-quarter inch of each other can be considered as at substantially or about the same location. Preferably the balance points will be within about one-eighth inch. With that weight and configuration of tuning point 26, the weight and balance point of the tuning arrow with the tuning point is substantially the same as the weight and balance point of the arrow with the broadhead. This assumes, as must be the case for proper tuning, that the arrow shaft and fletching for the tuning arrow is substantially the same as the arrow shaft and fletching used in the broadhead arrow, or that, if fletching is not used on the tuning arrow, the arrow shaft is weight and balance compensated for the fletching. Tuning the bow using the arrow with the tuning point tunes the bow for the arrow with the broadhead. Further, and importantly, the tuning point may be used in place of the ordinary field point for target shooting and non-big game hunting in the same manner as the field point would normally be used. This means that the bow will be tuned for and all shooting by the archer using the bow will be the same for all types of shooting, i.e., target or non-big game shooting using the tuning point in place of a normal field point, and big game shooting using the broadhead. The tune for both types of arrows will be the same.

The tuning point 26 may be made the approximate length of the broadhead to provide an equal total overall arrow length $L_1$ for the arrow with the broadhead and with the tuning point. However, as long as the balancing point 25 of the tuning point 26 is about equal to the balancing point 25 of the broadhead, the two arrows will perform substantially the same. Thus, the tuning point and the broadhead may be of different lengths as long as their weights and balancing points are about the same. In either case, however, the overall length of the arrow with broadhead, $L_1$, and arrow with tuning point is greater than the overall length $L_2$ of the arrow with the field point.

In a presently preferred form of the tuning point, the point is configured to be approximately the same length as a similar weight broadhead as shown in FIGS. 3 and 4. The tuning point includes an aluminum body 30 with a threaded portion 31 extending from the rearward end thereof to be screwed into the usual threaded insert 32 in the arrow shaft 20. A nonthreaded portion 33 adjacent the threaded portion 31 also fits into the threaded insert 32 in normal manner. A shoulder 34 at the forward end of the nonthreaded portion 33 abuts the forward end of the threaded insert 32, as shown, when the tuning point is screwed into the threaded insert 32. A steel tip 35 is threaded into internally threaded bore 36 in the forward end of tuning point body 30. The steel tip provides increased durability to the tip and also adds weight to the point. Rather than being threaded into the point body, the tip could be threaded over a threaded projection at the forward end of the body or otherwise secured to the forward end of the body. To add additional weight to the point and to balance the point similarly to a broadhead, a steel ring 37 extends over an intermediate point portion 38 immediately forwardly of the forward end of the arrow shaft and threaded insert 32. The diameter of the intermediate portion 38 is smaller than the outer diameter of the arrow shaft 20 and larger than the inner diameter of the threaded arrow insert 32 and terminates at its forward end in shoulder 39 where the outer diameter of the tuning point body 30 becomes substantially equal to the outer diameter of the arrow shaft 20 to form a central point portion. The ring 37 has an outer diameter substantially equal to the outer diameter of the arrow shaft so a substantially smooth extension of the arrow shaft extends forwardly of the shaft through the central point portion to a tapered forward point portion of the point body 30 that tapers smoothly to the tip 35. The length of the aluminum body 30 and the steel ring 37, together with steel tip 35, are configured to provide a desired weight and to give a balance point or center of gravity for the point at a location forwardly of the forward end of the arrow shaft substantially the same as the balance point location forwardly of the forward end of the arrow shaft for a broadhead of the same weight.

Figure 5:
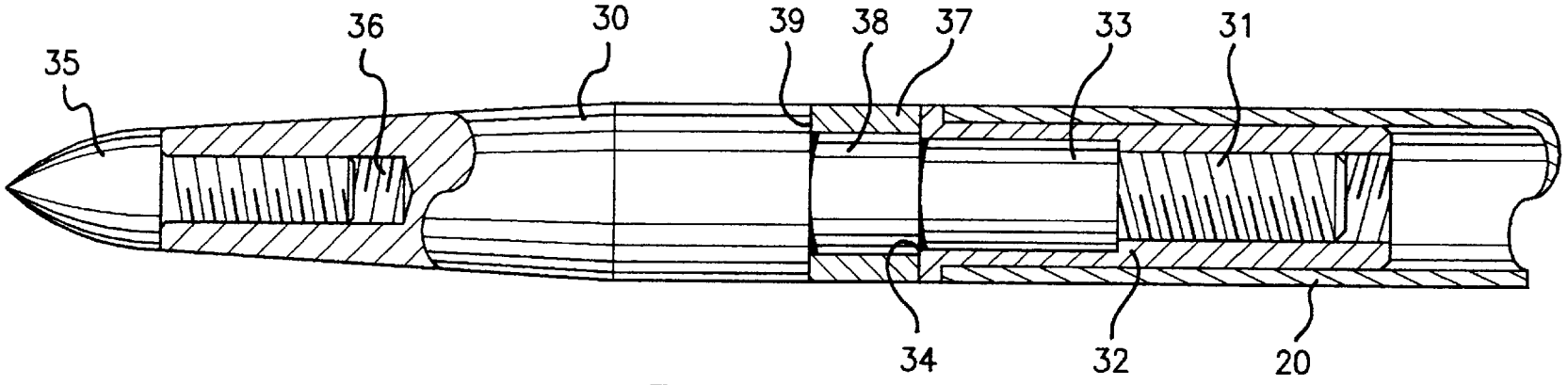
Figure 6:
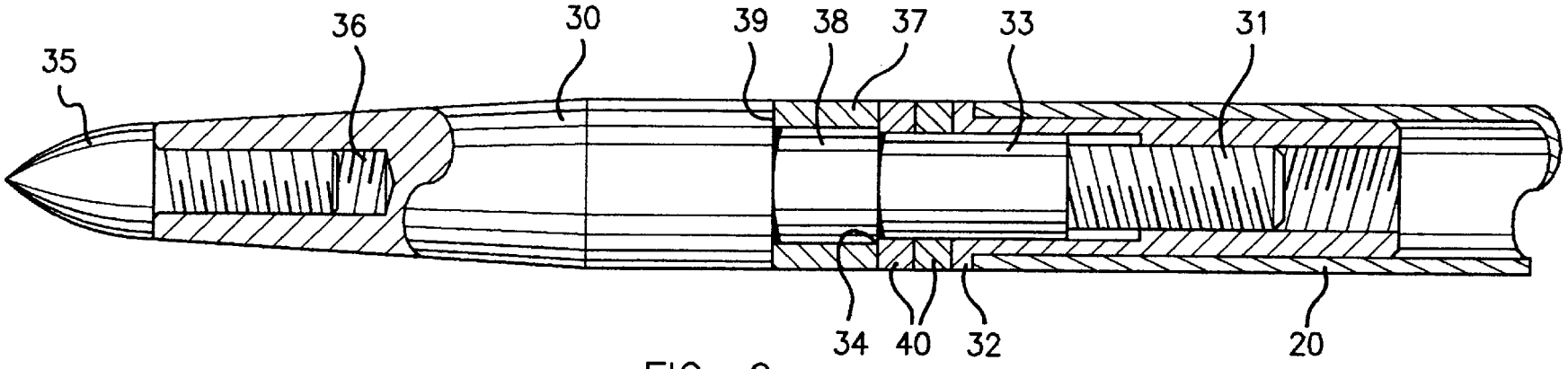
Figure 7:
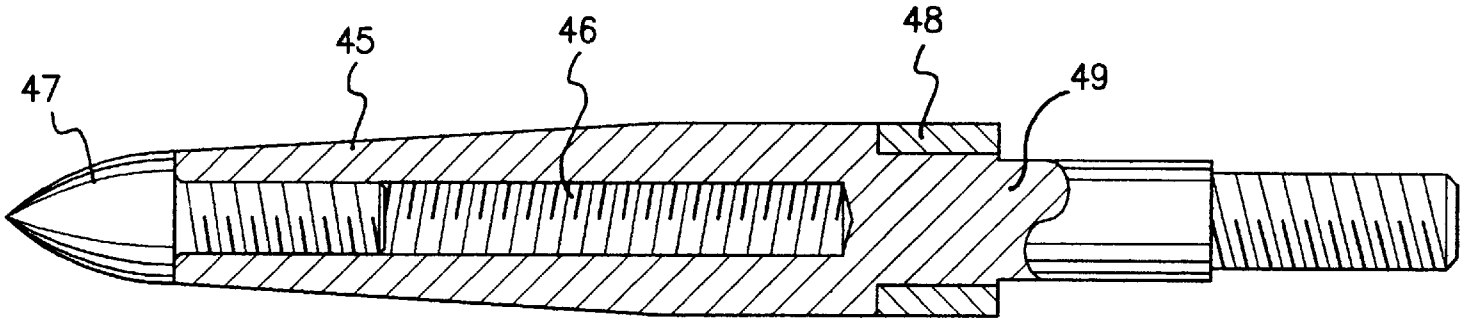
Figure 8:
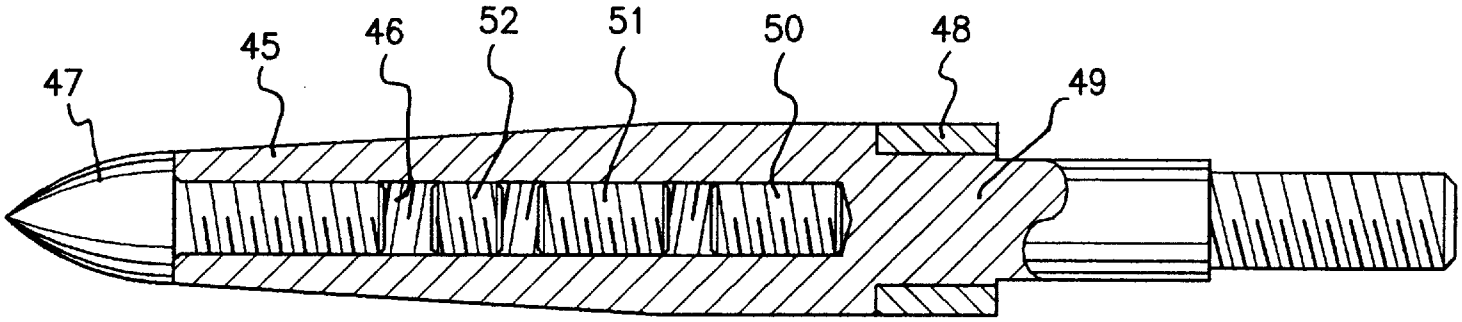

It has been found that if the weight of the tuning point of the invention is within about 2.5 grains of the weight of the broadhead used, the tuning arrow and the broadhead arrow will perform substantially the same so that tuning with arrows having the tuning point will provide a proper tune for similar arrows having the broadhead. Thus, a 100 grain tuning point can be used for broadheads weighing between about 97.5 and about 102.5 grains. In order to provide tuning points to be used with broadheads anywhere within a range of broadhead weights, it would be necessary to have a tuning point every five grains within the range. Thus, to be able to accommodate any broadhead within the range of 190 to 225 grains, tuning points would have to be available with values of 190, 195, 200, 205, 210, 215, 220, and 225 grains. It has been found, however, that weight collars can be added to the tuning point to add weight and extend the effective length of the point to adjust the weight and balance point of the tuning point over a limited weight range. While various size and weight collars could be used, it is presently preferred for ease of use to provide five grain weight collars that fit over the unthreaded portion 33 of the tuning point body. It has been found that up to three of the weight collars may be used with the tuning point configuration shown and still maintain a balance point for the tuning point close enough to that of a similar weight broadhead to be used as a tuning arrow for that broadhead. FIG. 6 shows two weight collars 40 positioned over unthreaded portion 33 of tuning point body 30 against shoulder 34 so as to be sandwiched between ring 37 and the front of threaded arrow insert 32. As shown in FIGS. 5 and 6, the tuning point is not screwed in as far into the threaded insert 32 when the weight collars are used so that the tuning point extends further forwardly from the forward end of the arrow shaft. A single collar 40 can be used to add five grains to the weight of the tuning point and two collars 40 can be used to add ten grains to the weight of the tuning point. In some cases, depending on the length and configuration of the threaded portion 31 of the point, a third collar can be used to add fifteen grains to the weight of the tuning point. Thus, a 70 grain tuning point can be made a 75 grain tuning point by the addition of one collar, an 80 grain tuning point by the addition of two collars, and where appropriate, an 85 grain tuning point by the addition of three collars. The use of the weight collars reduces the number of tuning point weights necessary to provide a tuning point equal to a particular desired broadhead. It should also be noted that a weight collar as used on the tuning point may also be used with a broadhead to increase the weight of a broadhead. The weight collar is added to the broadhead similarly as to the tuning point. With the tuning points and weight collars just about any broadhead can be matched with a tuning point. For example, if a desired broadhead weighs 133 grains, this can be matched with a 125 grain tuning point with two five grain weight collars added. This makes the tuning point weight 135 grains, within 2½ grains of the 133 grain broadhead. If a desired broadhead weighs 120 grains, and a 120 grain tuning point is not available but a 125 grain tuning point is available, one five grain weight collar can be added to the broadhead so the broadhead matches the weight of the 125 grain tuning point. Weight collars could also be configured to be added over the threaded portion of tip 35 to be sandwiched between tip 35 and point body 30. This will provide further flexibility in varying weight and balance point, if desired.

Where it is desired to make a single tuning point usable over a wider range of weights, a variable weight tuning point may be used. While this could be done in various ways, FIG. 7 shows a tuning point similar to that of FIGS. 5 and 6, with a point body 45 and an internally threaded bore 46 extending substantially further into point body 45 than similar bore 36 extends into point body 30 of FIGS. 5 and 6. A tip 47 is threaded into bore 46 at the forward end of the body and a weight ring 48 is positioned over intermediate body portion 49, similarly to the point shown in FIGS. 5 and 6. FIG. 7 shows the point without any added weight and such point would be configured for a specific weight such as 70 grains and for a tuning point balance point substantially equal to 70 grain broadheads. The tuning point would be used as previously described. To make the point heavier, threaded weight inserts, similar to set screws, are provided in predetermined weights such as five grains and ten grains. Tip 47 is removed and the threaded weights are screwed into bore 46 to desired position to provide a desired balance point. For example, two ten grain weights 50 and 51 and one five grain weight 52 could be screwed in and positioned as shown in FIG. 8 to provide a 95 grain tuning point. Different combinations of threaded weights can be used to produce different weight tuning points, and the locations of the respective weights in bore 46 can be adjusted to adjust the balance point of the tuning point. The threaded weights can be designed to be screwed into bore 46 using an alien wrench, screw driver, or other driving means. Various combinations of threaded weights and weight collars could also be used to vary the weight of the tuning point over a wide range.

Figure 9:
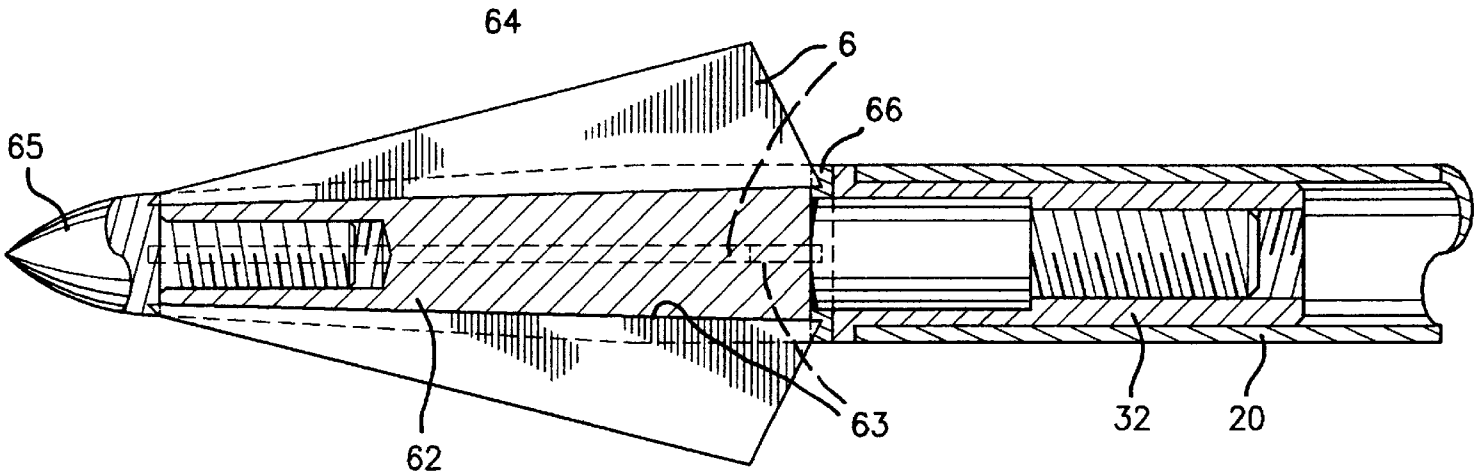
Figure 10:
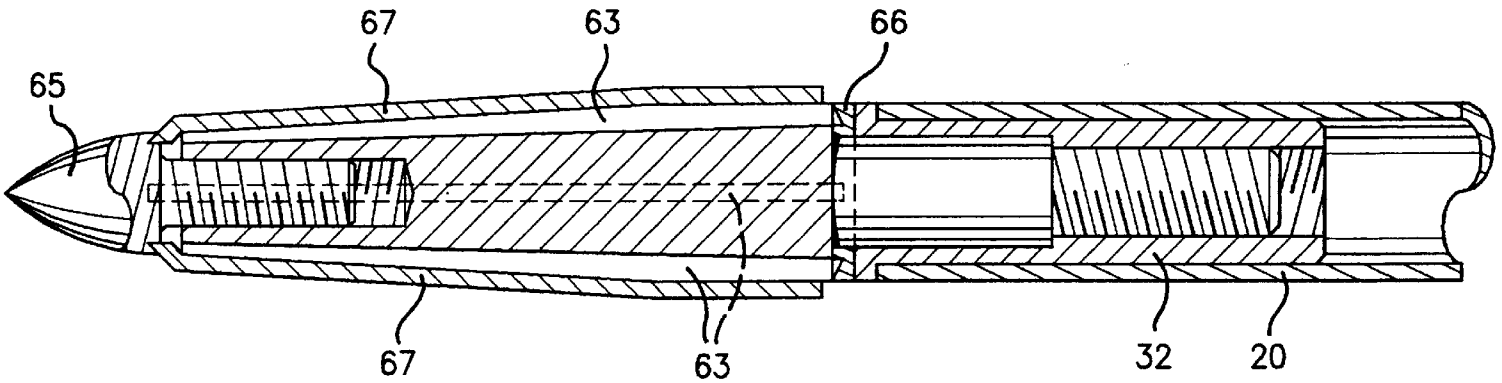

Rather than having a separate tuning point for use with the tuning arrow, the body and tip portion of a broadhead can be modified to provide the tuning point. FIG. 9 shows generally a broadhead having a body 62 with four elongate slots 63 extending the length thereof to receive four removable broadhead blades 64 positioned therein. Only three of the slots and blades are visible in FIG. 9. The front of the blades 64 are secured in place by screw in tip 65. The rear of the blades are held in place by ring 66 sandwiched between the broadhead body and the front of threaded arrow insert 32 in arrow shaft 20. This broadhead is used for big game hunting. When it is desired to tune the bow or to use the bow for target shooting or non-big game hunting, the broadhead can be easily converted to a tuning point of the invention by removing the blades and adding weight to the broadhead body 62 substantially equal to the weight of the blades that have been removed. The added weight is positioned in a manner to keep the balance point substantially the same as when the blades are present. This can be done in various ways such as by adding a rear weight collar similar to 40 in FIG. 6 and a forward weight collar between body 62 and tip 65. The relative weights of the respective weight collars are such as to maintain substantially the same balance point for the point. Alternatively, as shown in FIG. 10, a sleeve 67 can be positioned over body 62 over its length to add substantially the same weight in substantially the same distribution as the broadhead blades. The sleeve has the advantage that, as shown in FIG. 10, it covers slots 63 to protect such slots from getting filled in with dirt or other debris so that upon removal of sleeve 67, blades 64 can easily be added to make the broadhead for big game hunting. The broadhead blades and the sleeve can be easily removed or installed by removing the tip 65.

While tuning for an arrow using a broadhead can be done with a tuning arrow using a tuning point 26 as shown in FIG. 4 with the tuning arrow having fletching 22, and a relatively good tune can be achieved, for a good fine tune of the bow, the fletching 22 on the rearward portion of the arrow shaft should be removed so tuning can be done without the stabilizing effect of the fletching on the arrow. The elimination of the fletching eliminates rear-end steerage of the arrow and makes small tuning problems easy to detect. However, as indicated above, removal of the fletching eliminates the weight of the fletching from the arrow so the arrow has a different weight and balancing point than does the arrow with the fletching. In accordance with the invention, however, when the fletching is removed or not added to the shaft to begin with, the shaft is weight and balance compensated so that weight substantially equal to the weight of the fletching is added to the shaft and is positioned so that the balance point of the arrow remains substantially the same as with the fletching present. The weight of the fletching can be determined by a table indicating weight for the particular fletching used, or by actually weighing the fletching removed from or normally used with the arrow.

In a preferred form of the invention, an adhesive backed weight strip is provided having a preset weight per unit length, for example, a weight of ten grains per inch. A length of the strip is measured to provide desired weight and cut to that length. The backing is removed from the adhesive on the strip and the strip applied to the arrow shaft centered lengthwise in the area where the fletching would be. For example, as shown in FIG. 11, a weight strip 70 is attached to arrow shaft 20 in the area where fletching 22 would normally be. The strip is applied to a side of the arrow shaft where it will not hit the arrow rest as the arrow is shot from the bow. For most V-launcher type arrow rests, the weight strip should be on the top of the arrow shaft when the arrow is nocked to the bowstring in shooting position on the bow. For most side-control type rests, the weight strip should be positioned along the arrow shaft halfway between the top and side away from the bow.

Using the weight strip, if the fletching consists of three plastic vanes each weighing 15 grains, the combined weight of the vanes is 45 grains. A four and one-half inch length of weight strip weighing ten grains per inch would be cut and secured to the arrow shaft in a position such as shown for weight strip 70 in FIG. 7. With the weight strip, a length to match any weight fletching can be measured and cut.

Rather than using a single weight strip as described, various other methods of adding weight can be used, such as using multiple weight strips positioned substantially where fletching was or would be affixed to the arrow shaft or by wrapping tape, such as electrical or duct tape, around the arrow shaft in the area of the fletching. The weight of tape added should be about the same as the weight of the fletching not present. The use of multiple weight strip or wrapping of tape can be used with finger shooting with some types of arrow rests, but is not presently preferred for other shooting because one or more of the multiple weight strips, or the tape can hit the arrow rest and distort arrow flight.

Where a bow is to be tuned for an arrow using a field point or practice point, such as a target shooter tuning a bow for target shooting rather than hunting purposes, the usual field or practice point as normally used by that archer will be used on the tuning arrow, but the fletching will be removed and compensated for to make the tuning arrow.

Figure 12:
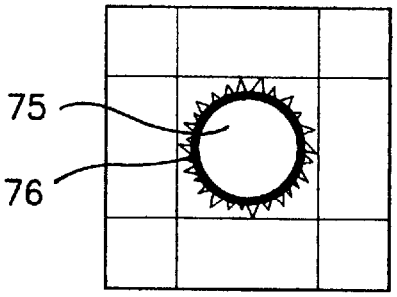
Figure 13:
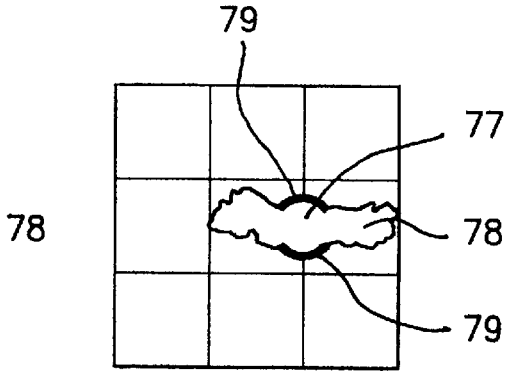

Paper tuning, i.e., shooting the tuning arrow through a sheet of paper, works well with a tuning arrow without fletching, and with the tuning point of the invention, or, where desired with a usual field or practice point. It is best to start paper tuning using paper about five feet away. It is preferred to apply a ring of ink to the point of the tuning arrow just prior to shooting so the arrow point will leave a ring on the paper when the point passes through. The tear in the paper then indicates tuning problems and adjustments to make. FIG. 12 shows a hole obtained with a well tuned bow using an arrow release aid. The hole is a near perfect bullet hole 75 through the paper with the arrow point marker ring 76 formed by the ink surrounding the hole. FIG. 13 shows a well tuned bow for a finger release shooter. The hole 77 is slightly oval with a horizontal tear 78 no more than three-quarter inch wide (the drawings are larger than actual size) with the arrow point marker 79 in the center of the tear.

Figure 14:
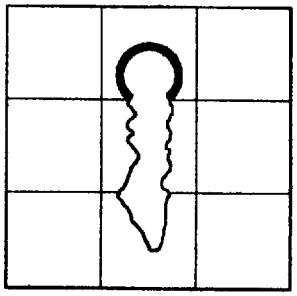
Figure 15:
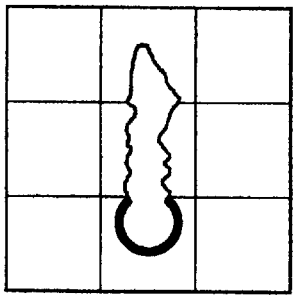
Figure 16:
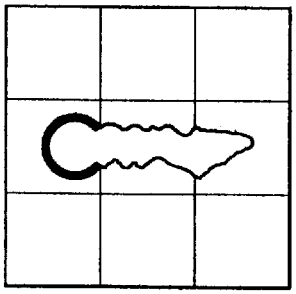
Figure 17:
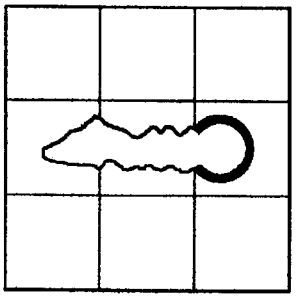
Figure 18:
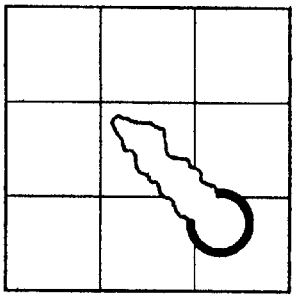

FIG. 14 shows a tail low tear. This indicates that the nock locator should be moved up. FIG. 15 shows a tail high tear indicating that the nock locator should be moved down. FIG. 16 shows a tail right tear indicating that the arrow rest should be moved to the right. FIG. 17 shows a tail left tear indicating that the arrow rest should be moved to the left. Combination paper tears such as shown in FIG. 18 indicate both the nock locator and arrow rest should be moved. FIG. 18 indicates the nock locator should be moved down and the arrow rest should be moved to the left.

With the bow well tuned for close range paper, such as five feet, the distance to the paper can be increased to ten feet and then twenty feet with fine tuning adjustments made at each distance.

Tuning can also be done without paper. Tuning arrows can be shot into sand, loose dirt, or any commercial target, starting at close range of about five feet and then, as with the paper tune, moving to further range such as ten and twenty feet. The arrow is watched as it strikes the target. As with the paper tune, if the arrow strikes the target tail high, lower the nock locator. If it strikes tail low, raise the nock locator. If it strikes tail right, move the arrow rest to the right. If it strikes tail left, move the arrow rest to the left.

With any tuning method, several shots should be taken, preferably about five shots, and adjustment made to correct how the arrow flies for most of the shots. It should also be noted that the tuning arrows used should all be straight and preferably tested for straightness periodically. The tuning method of the invention is further described in an instruction booklet entitled *The Chuck Adams MatchPoint Tuning System* provided with a kit of parts for tuning available from Satellite Archery Industries, L.L.C. in Odessa, Fla., and incorporated herein by reference. The kit includes at least one tuning point and generally several tuning points of assorted weight, weight collars for use with the tuning points or broadheads, a length of adhesive backed weight strip, a point marking pen, and instructions.

When the bow is properly tuned, all arrows for which the bow has been tuned for should fly similarly and hit substantially the same place on a target when shot similarly from the bow. When the bow is tuned for a broadhead arrow, once the match has been made between tuning point and broadhead, the tuning point, after tuning the bow, can be used for target shooting, non-big game animal hunting, or other desired shooting and the bow will be properly tuned for all such shooting, including shooting with the desired broadheads. When properly tuned, an arrow with the tuning point and an arrow with the broadhead will hit substantially the same place when shot similarly from the bow.

While the tuning point has been shown screwed into a threaded insert in the forward end of the arrow, the point could be attached to the arrow in various ways, and generally will be secured to the arrow in a manner similar to the way the broadhead is attached. Further, while the point is shown and described with an aluminum body and steel tip and ring, the point could be made completely of steel or of other materials or combination of materials as long as it is configured so that its balance point is substantially the same as the balance point of similar weight broadheads.

While it has been indicated that the weight of the tuning point should be within about 2.5 grains of the weight of the broadhead and that the location of the balance point of the tuning point should be within about one-quarter inch of the location of the balance point of the broadhead, and that within these values good tuning of the bow is achieved, it should be realized that some variation from these ranges, while not providing the fine tune desired by some archers, can provide a tune satisfactory to other archers. The change in satisfactory tuning is a matter of degree with a tune satisfactory to substantially all archers being achievable with weight and balance point within the specified ranges. Generally when the term substantially equal or substantially the same is used, it means a value close enough to the value it is substantially equal to or substantially the same as so that the tuning arrow when shot from a bow will perform similarly to the arrow being tuned for when shot similarly from that same bow. Further, while a compound archery bow has been shown as an example, any type of bow may be tuned as described.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A method of tuning an archery bow to be tuned for use with a particular combination of an arrow shaft having particular shaft characteristics, a selected arrow point, and arrow fletching, the arrow point and arrow fletching being items extending from the arrow shaft, comprising the steps of:

obtaining an arrow shaft having the particular shaft characteristics, but without at least one of the items extending from the arrow shaft;

weight and balance compensating the obtained arrow shaft for the at least one of the items not extending from the arrow shaft to form a tuning arrow whereby the tuning arrow has substantially the same weight and substantially the same balance point as the arrow shaft with the selected arrow point and arrow fletching; and shooting the tuning arrow from the archery bow to be tuned and tuning the archery bow to provide desired flight results of the tuning arrow.

2. A method of tuning an archery bow according to claim 1, wherein the selected arrow point is a selected broadhead having a weight and broadhead balance point, wherein the at least one item not extending from the tuning arrow is the selected broadhead, and wherein the step of weight and balance compensating the obtained arrow shaft includes securing a tuning point which has a weight substantially the same as the weight of the selected broadhead and a balance point substantially the same as the selected broadhead balance point to the forward end of the arrow shaft to form the tuning arrow.

3. A method of tuning an archery bow according to claim 2, wherein the weight is approximately equal if within about 2½ grains.

4. A method of tuning an archery bow according to claim 2, wherein the balance point of the tuning arrow is approximately equal if the location of the balance point of the tuning point ahead of the front of the arrow shaft when the point is secured to the forward end of the arrow shaft is approximately the same as the location of the balance point of the given broadhead when attached to the forward end of an arrow shaft.

5. A method of tuning an archery bow according to claim 4, wherein the balance point is approximately equal if the locations are within about one-quarter inch.

6. A method of tuning an archery bow according to claim 2, wherein the at least one item not extending from the tuning arrow is also the fletching, and wherein the step of weight and balance compensating the obtained arrow shaft includes securing weight substantially equal to the weight of the fletching to the obtained arrow shaft in the area where the fletching usually extends from the arrow shaft to form the tuning arrow.

7. A method of tuning an archery bow according to claim 6, wherein the step of securing weight to the obtained arrow shaft includes obtaining a weight strip of desired weight and securing the weight strip to the arrow shaft.

8. A method of tuning an archery bow according to claim 7, wherein the archery bow includes an arrow rest, and wherein the weight strip is secured to the arrow shaft in a location so it does not contact the arrow rest when the arrow is shot from the bow.

9. A method of tuning an archery bow according to claim 6, wherein the step of securing weight to the obtained arrow shaft includes securing multiple weight strips of desired total weight to the arrow shaft.

10. A method of tuning an archery bow according to claim 6, wherein the step of securing weight to the obtained arrow shaft includes securing tape of a desired weight to the arrow shaft.

11. A method of tuning an archery bow according to claim 1, wherein the selected arrow point is a selected point other than a broadhead, wherein the at least one item not extending from the tuning arrow is the fletching, and wherein the step of weight and balance compensating the obtained arrow shaft includes securing weight substantially equal to the weight of the fletching to the obtained arrow shaft in the area where the fletching usually extends from the arrow shaft to form the tuning arrow.

12. A method of tuning an archery bow according to claim 11, wherein the step of securing weight to the obtained arrow shaft includes obtaining a weight strip of desired weight and securing the weight strip to the arrow shaft.

13. A method of tuning an archery bow according to claim 12, wherein the archery bow includes an arrow rest, and wherein the weight strip is secured to the arrow shaft in a location so it does not contact the arrow rest when the arrow is shot from the bow.

14. A method of tuning an archery bow according to claim 11, wherein the step of securing weight to the obtained arrow shaft includes securing multiple weight strips of desired total weight to the arrow shaft.

15. A method of tuning an archery bow according to claim 11, wherein the step of securing weight to the obtained arrow shaft includes securing tape to the arrow shaft.

16. A method of tuning an archery bow to be tuned for use with a particular combination of an arrow shaft having particular selected shaft characteristics and a broadhead having broadhead blades and particular selected broadhead characteristics, comprising the steps of:

obtaining an arrow shaft having the particular selected shaft characteristics;

obtaining an arrow point having the particular selected broadhead characteristics, but not having broadhead blades;

mounting the obtained arrow point to the obtained arrow shaft to provide a tuning arrow;

shooting the tuning arrow from the archery bow to be tuned and tuning the archery bow to provide desired flight results of the tuning arrow.

17. A method of tuning an archery bow to be tuned according to claim 16, wherein the selected broadhead characteristics are the weight and the broadhead balance point.

18. A method of tuning an archery bow to be tuned according to claim 17, wherein the obtained arrow shaft has fletching thereon, and comprising the additional steps prior to shooting the tuning arrow of removing the fletching from the arrow shaft, and securing weight along the arrow shaft in place of the fletching, the weight being substantially equal to the weight of the removed fletching.

19. A method of fine tuning an archery bow to be tuned according to claim 18, wherein the fletching is removed from a fletching area of the shaft and the weight is secured to the arrow shaft along a side of the shaft which does not contact an arrow rest when the arrow is shot and in approximately the center of the fletching area.

20. A tuning arrow for use by an archer in tuning an archery bow for an arrow having a selected arrow point and arrow fletching normally used by the archer in shooting the bow, said arrow fletching normally used providing steerage for the arrow, comprising an arrow shaft, an arrow point of weight and balance substantially the same as the weight and balance of the selected point normally used by the archer, and non-steering weight compensation material on the rearward portion of the arrow in place of the fletching normally used by the archer and of weight substantially the same as the weight of the fletching replaced and located so that the tuning arrow will fly similarly to the arrow being toned for when shot from the bow.

21. A tuning arrow according to claim 20, wherein the selected arrow point is not a broadhead, and the arrow point of weight and balance substantially the same as the weight and balance of the selected point normally used is the selected point normally used.

22. A tuning arrow according to claim 20, wherein the selected arrow point is a broadhead having blades, and the arrow point of weight and balance substantially the same as the weight and balance of the selected point normally used does not have blades.

23. A kit of parts for use by an archer in tuning an archery bow for an arrow having a selected arrow point and bow, said arrow fletching normally used providing steerage for the arrow, comprising at least one arrow point of selected weight and having a balance point substantially equal to balance points of broadheads of substantially equal weight, and non-steering weight compensation material which can be selected in a variety of weights to be selected by normally used to be secured in a substantially non-steering manner to an arrow shaft, in place of the normal fletching, to weight and balance compensate the arrow for the fletching, in place of the fletching.

24. A kit of parts for use by an archer in tuning an archery bow according to claim 23, additionally including weight adjustment means to be used in cooperation with the at least one arrow point to adjust the weight of the at least one arrow point.

* * * * *